US009031444B2

(12) United States Patent
Kimata et al.

(10) Patent No.: US 9,031,444 B2
(45) Date of Patent: May 12, 2015

(54) IMAGE FORMING APPARATUS PROVIDED WITH FIXING UNIT FOR FIXING IMAGES FORMED ON PAPER AND METHOD OF CONTROLLING HEATERS OF THE APPARATUS

(71) Applicant: Konica Minolta, Inc., Tokyo (JP)

(72) Inventors: Akinori Kimata, Aichi (JP); Yoshihito Sasamoto, Tokyo (JP); Tadayuki Ueda, Tokyo (JP); Toru Kasamatsu, Aichi (JP); Eiji Nishikawa, Tokyo (JP); Takanobu Shiki, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/887,190

(22) Filed: May 3, 2013

(65) Prior Publication Data

US 2013/0302058 A1 Nov. 14, 2013

(30) Foreign Application Priority Data

May 9, 2012 (JP) ..... 2012-107404

(51) Int. Cl.
*G03G 15/20* (2006.01)
*G03G 15/00* (2006.01)

(52) U.S. Cl.
CPC ..... *G03G 15/205* (2013.01); *G03G 15/2064* (2013.01); *G03G 15/2078* (2013.01); *G03G 2215/2016* (2013.01); *G03G 15/5004* (2013.01); *G03G 15/2003* (2013.01); *G03G 15/2042* (2013.01)

(58) Field of Classification Search
CPC ..... G03G 15/20
USPC ..... 399/67, 69–70
See application file for complete search history.

(56) References Cited

U.S. PATENT DOCUMENTS

| | | | | |
|---|---|---|---|---|
| 5,862,436 | A * | 1/1999 | Ishizawa et al. | 399/69 |
| 6,311,028 | B1 * | 10/2001 | Matsudaira | 399/69 |
| 6,810,220 | B2 * | 10/2004 | Hamada et al. | 399/69 |
| 7,971,955 | B2 * | 7/2011 | Nillesen | 347/17 |
| 8,103,183 | B2 * | 1/2012 | Nemoto et al. | 399/69 |
| 2003/0190170 | A1 * | 10/2003 | Hamada et al. | 399/69 |

(Continued)

FOREIGN PATENT DOCUMENTS

| | | | | |
|---|---|---|---|---|
| JP | 2003-173107 | | 6/2003 | |
| JP | 2006-079055 | * | 3/2006 | G03G 15/20 |

(Continued)

OTHER PUBLICATIONS

Translation of the Rejection Notice issued by JPO for appl. No. 2012-107404, dispatched Aug. 5, 2014, 3 pgs.

*Primary Examiner* — Clayton E Laballe
*Assistant Examiner* — Kevin Butler
(74) *Attorney, Agent, or Firm* — Squire Patton Boggs (US) LLP

(57) ABSTRACT

An image forming apparatus includes a plurality of heaters 56 for heating the fixing roller 52, a plurality of temperature sensors 57 for detecting the temperatures of the areas to be heated by the plurality of heaters 56 respectively, and a control unit 11 for turning on and off the plurality of heaters 56 on the basis of the temperatures detected by the plurality of temperature sensors 57. If one of the heaters 56 is on when the area to be heated by the other heater cools down to the ON temperature, the control unit 11 turns on the other heater with the same timing as the one heater is turned off.

5 Claims, 7 Drawing Sheets

(56) References Cited

U.S. PATENT DOCUMENTS

| | | | | |
|---|---|---|---|---|
| 2007/0217804 | A1* | 9/2007 | Mikita et al. | 399/69 |
| 2007/0217805 | A1* | 9/2007 | Inoue et al. | 399/69 |
| 2007/0292155 | A1* | 12/2007 | Kida | 399/69 |
| 2009/0052927 | A1* | 2/2009 | Yoshikawa | 399/69 |
| 2010/0239301 | A1* | 9/2010 | Nemoto et al. | 399/69 |
| 2013/0302058 | A1* | 11/2013 | Kimata et al. | 399/70 |

FOREIGN PATENT DOCUMENTS

| | | | | |
|---|---|---|---|---|
| JP | 2006079055 | * | 3/2006 | G03G 15/20 |
| JP | 2011-242429 | | 12/2011 | |

* cited by examiner

Fig. 8

Before-switch period

| | requirement | ON temperature if satisfied | ON temperature if not satisfied |
|---|---|---|---|
| center heater | center or side heater is on | target temperature + hysterisis temperature | target temperature − hysterisis temperature |
| side heater | center or side heater is on | target temperature + hysterisis temperature | target temperature − hysterisis temperature |

After-switch period

| | requirement | ON temperature if satisfied | ON temperature if not satisfied |
|---|---|---|---|
| center heater | center heater is on | target temperature + hysterisis temperature | target temperature − hysterisis temperature |
| side heater | side heater is on | target temperature + hysterisis temperature | target temperature − hysterisis temperature |

IMAGE FORMING APPARATUS PROVIDED WITH FIXING UNIT FOR FIXING IMAGES FORMED ON PAPER AND METHOD OF CONTROLLING HEATERS OF THE APPARATUS

CROSS-REFERENCE TO RELATED APPLICATIONS

The present application claims priority under 35 U.S.C. §119 to Japanese Patent Application No. P2012-107404, filed May 9, 2012. The contents of this application are herein incorporated by reference in their entirety.

BACKGROUND OF THE INVENTION

1. Field of Invention

The present invention relates to an image forming apparatus provided with a fixing unit for fixing images formed on paper and a method of controlling heaters of the same.

2. Description of Related Art

Conventionally, a fixing unit has been proposed which includes a pressure heater for heating a pressure roller, a first and a second heater for heating a fixing roller together with the fixing belt running around the fixing roller. In accordance with this fixing unit, the pressure heater and the first and second heaters are controlled in order not to be concurrently on (energized) so that the maximum power consumption is kept down to suppress fluctuation in voltage and avoid the occurrence of a flicker, as described in Japanese Patent Published Application No. 2006-79055.

However, if there is a timing skew in the synchronized on/off operations of the heaters in the conventional image forming apparatus provided with a fixing unit, even though the skew is very small, voltage fluctuation may occur with asynchronous operations of the heaters to cause a flicker. For an instance, it is assumed that the first and second heaters are located adjacent each other. In this case, since these heaters are controlled in order not to be concurrently on, one of the heater remains off while the other heater is on, such that the area of the fixing roller to be heated by the one heater is inadvertently heated by the other heater which is on. On the other hand, these heaters are turned on/off by detecting the temperature of the areas to be heated by these heaters respectively. For example, a heater is turned on when the area to be heated by the heater cools down to a predetermined ON temperature, and also turned off when the area to be heated by the heater is heated to a predetermined OFF temperature. Because of this, since one heater which is on is inadvertently heating the area of the fixing roller to be heated by the other heater which is off, this area may not cool down to the ON temperature even after the one heater is turned off at the OFF temperature, such that the other heater is sometimes not turned on in this situation to disturb synchronization. This results in an asynchronous operation causing voltage fluctuation which in turn causes flickers. Meanwhile, this problem is not limited to the case where a plurality of heaters are adjacent each other but also applied to the case where a plurality of heaters are distant from each other because voltage fluctuation commonly occurs when these heaters are turned on/off asynchronously.

To achieve at least one of the abovementioned objects, an image forming apparatus reflecting one aspect of the present invention is provided with a fixing unit which fixes an image formed on a paper sheet by passing the paper sheet between a pair of rotatable members and comprises: a plurality of heaters configured to heat at least one of the rotatable members; a plurality of temperature detection units configured to detect the temperatures of areas to be heated by said plurality of heaters respectively; and a control unit configured to turn off each of the plurality of heaters when the temperature detected by one of the temperature detection units corresponding to the each heater rises to an OFF temperature, and turn on each of the plurality of heaters when the temperature detected by one of the temperature detection units corresponding to the each heater falls to an ON temperature, wherein if one of said plurality of heaters is on when another of said plurality of heaters cools down to the ON temperature, the control unit turns off the one heater and turns on the another heater at the same time when the area to be heated by the one heater is heated to the OFF temperature.

Also, to achieve at least one of the abovementioned objects, a heater control method for an image forming apparatus, which is provided with a fixing unit which fixes an image formed on a paper sheet by passing the paper sheet between a pair of rotatable members, comprises: a heating step of heating at least one of the rotatable members with a plurality of heaters; a temperature detecting step of detecting the temperatures of areas to be heated by said plurality of heaters respectively; and a control step of turning off each of the plurality of heaters when the temperature detected by one of the temperature detection units corresponding to the each heater rises to an OFF temperature, and turning on each of the plurality of heaters when the temperature detected by one of the temperature detection units corresponding to the each heater falls to an ON temperature, wherein if one of said plurality of heaters is on when another of said plurality of heaters cools down to the ON temperature, in the control step, the one heater and the another heater are turned off and on respectively at the same time when the area to be heated by the one heater is heated to the OFF temperature.

BRIEF DESCRIPTION OF THE DRAWINGS

FIG. 8 shows the heater control temperature of the image forming apparatus in accordance with the first embodiment.

DETAILED DESCRIPTION OF THE PREFERRED EMBODIMENT

Hereinafter, a description is given of embodiments of the present invention with reference to the drawings.

Figure 1:
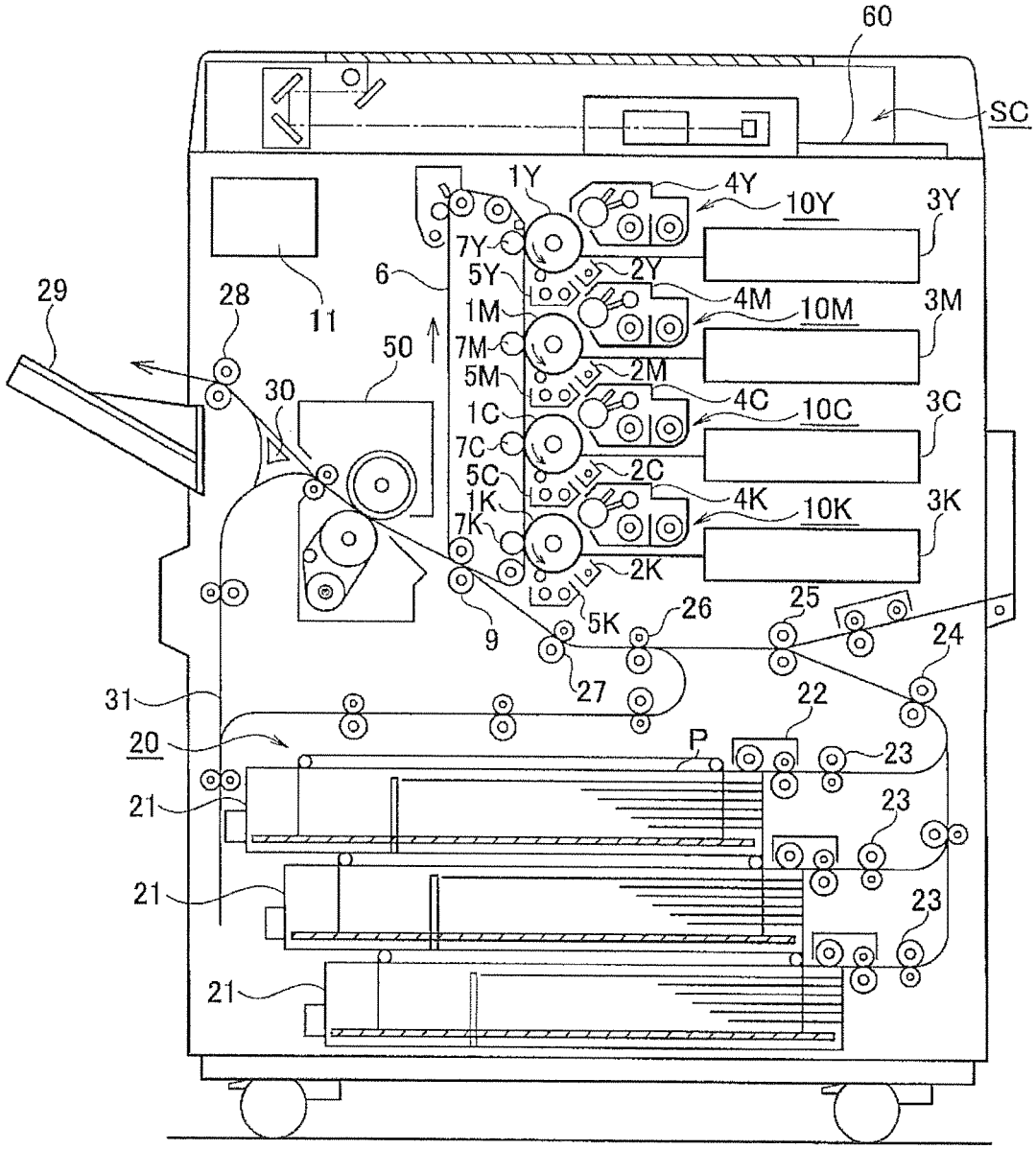
FIG. 1 is a view for schematically showing the configuration of an image forming apparatus in accordance with a first embodiment of the present invention.

FIG. 1 shows an image forming apparatus according to a first embodiment of the present invention such as a copying machine which is an electrophotographic image forming apparatus called a tandem color image forming apparatus.

The tandem color image forming apparatus includes a plurality of photoreceptor drums vertically arranged in contact with one intermediate transfer belt to form full-color images. Incidentally, while the full-color image forming apparatus shown in FIG. 1 is an explanatory example, the present invention is not limited thereto but applicable to other image forming apparatuses such as a rotary-type image forming apparatus.

The image forming apparatus consists mainly of an original reading unit SC, four image forming units 10Y, 10M, 10C and 10K, and a fixing unit 50 which are installed within one housing.

The original reading unit SC scans and exposes the image of an original with an optical system of a scanning exposing device, and reads the reflected light therefrom with a line image sensor to obtain image signals. The image signals are processed by performing A/D conversion, shading compensation, data compression and so on, and input to a control unit 11 as image data. Incidentally, the image data input to the control unit 11 is not limited to the image data as captured by the original reading unit SC, but can be the data for example as received from another image forming apparatus, a personal computer or the like connected to the image forming apparatus.

The four image forming units 10Y, 10M, 10C and 10K are an image forming unit 10Y for forming yellow (Y) images, an image forming unit 10M for forming magenta (M) images, an image forming unit 10C for forming cyan (C) color images, and an image forming unit 10K for forming black (K) images.

The image forming unit 10Y is provided with a photoreceptor drum 1Y, and a charging unit 2Y, an optical writing unit 3Y, a development apparatus 4Y and a drum cleaner 5Y which are arranged around the photoreceptor drum 1Y. Likewise, the other image forming units 10M, 10C and 10K are provided with photoreceptor drums 1M, 1C and 1K, and charging units 2M, 2C and 2K, optical writing units 3M, 3C and 3K, development apparatuses 4M, 4C and 4K, drum cleaners 5M, 5C and 5K which are arranged around the photoreceptor drums 1M, 1C and 1K respectively.

The surfaces of the photoreceptor drums 1Y to 1K are uniformly charged with electricity by the charging units 2Y to 2K, and the optical writing units 3Y to 3K performs a scanning exposure process to form latent images on the photoreceptor drums 1Y to 1K. The development apparatuses 4Y to 4K then make visible the latent images on the photoreceptor drums 1Y to 1K by developing the images with toners. Toner images are thereby formed on the photoreceptor drums 1Y to 1K respectively corresponding to yellow, magenta, cyan and black. The toner images formed on the photoreceptor drums 1Y to 1K are transferred to a predetermined location of an intermediate transfer belt 6 to first transfer rollers 7Y, 7M, 7C and 7K.

The toner image consisting of respective color components transferred to the intermediate transfer belt 6 is transferred to a sheet P as a recording medium conveyed with a predetermined timing by a transfer roller 9.

The paper feed unit 20 feeds a sheet P. Sheets P are stored in paper feed trays 21 and transferred to a main conveying route from the uppermost sheets by a first paper feed unit 22. In this main conveying route, there are intermediate conveyance rollers 23 to 25, loop rollers 26 and resist rollers 27 in the upstream side of the image formation position, where an image is formed on a sheet P, more specifically, in the upstream side of the transfer position (i.e., the nip portion between the intermediate transfer belt 6 and the second transfer roller 9) where a toner image is transferred to a sheet P. The sheet P transferred from the first paper feed unit 22 is conveyed to the transfer position by a plurality of conveyance members including the intermediate conveyance rollers 23 to 25, the loop rollers 26 and the resist rollers 27. Each conveyance member consists of, for example, a pair of conveyance rollers.

Figure 2:
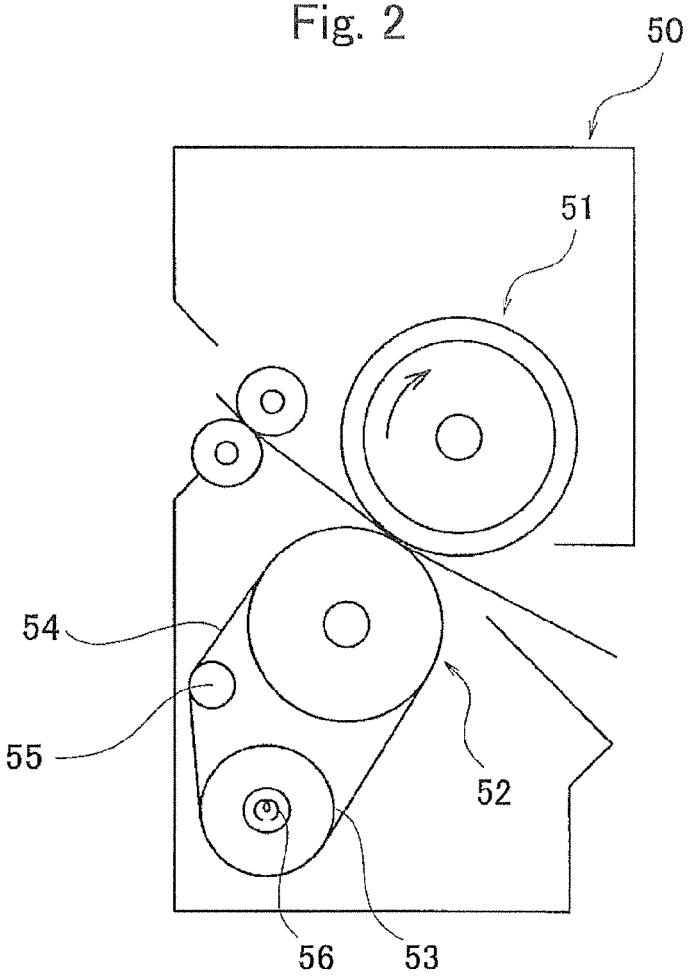
FIG. 2 is an enlarged view of the fixing unit shown in FIG. 1.

As shown in FIG. 2, the fixing unit 50 is provided with a pressure roller (rotatable member) 51 and a fixing roller (rotatable member) 52 to fix the toner image to a sheet P by passing the sheet P between the pressure roller 51 and the fixing roller 52. This fixing unit 50 fixes the toner image to a sheet P with heat of the fixing roller 52 under the pressure by the pressure roller 51 while the sheet P is conveyed through the fixing nip portion.

After the fixing treatment with the fixing unit 50, the sheet P is discharged by a discharging roller 28 to a catch tray 29 attached to the external side of the housing as shown in FIG. 1. When an image is to be formed also on the back side of the sheet P, i.e., when a double-side printing operation is performed, the sheet P is conveyed to a switchback conveying route 31 by a guide member 30 to reverse the front and back sides, and then conveyed to the image formation position again. Incidentally, the command to perform the double-side printing is issued by a manipulation unit 60 or a personal computer connected to the image forming apparatus.

As shown in FIG. 2, the fixing unit 50 is provided with a heat roller 53, a fixing belt 54 and a tension roller 55. A plurality of heaters 56 are provided in the heat roller 53. The plurality of heaters 56 are controlled by the control unit 11 to turn on and off so that the fixing roller 52 and the heat roller 53 are heated by turning on the heaters 56. The fixing belt 54 extends also around the tension roller 55 which applies an appropriate tension to the fixing belt 54.

Figure 3:
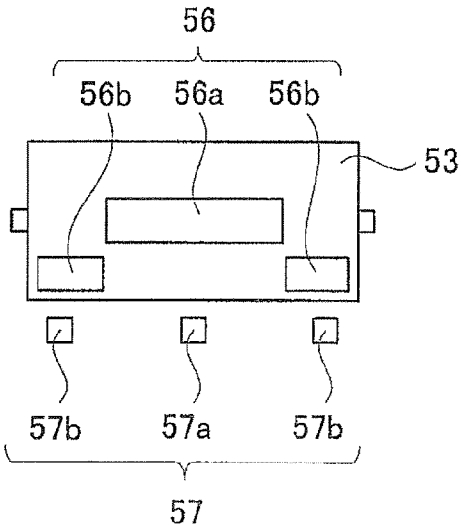
FIG. 3 is a schematic diagram for showing a heat roller and thereabouts.

As shown in FIG. 3, the plurality of heaters 56 include a center heater 56*a* located in a center area of the heat roller 53 to heat the center area and side heaters 56*b* located near the opposite side areas of the heat roller 53 to heat the side areas.

The fixing unit 50 is provided with a plurality of temperature sensors (temperature detecting unit) 57. The plurality of temperature sensors 57 are located in a one-to-one correspondence with the plurality of heaters 56 in order to detect the areas to be heated by the heaters 56 respectively. Specifically speaking, the plurality of temperature sensors 57 include a center sensor 57*a* and side sensors 57*b*. The center sensor 57*a* is located closer to the center area to be heated than the side sensors 57*b*. On the other hand, the side sensors 57*b* are located closer to the side areas to be heated than the center sensor 57*a*. This arrangement makes it possible to accurately detect the temperatures of the areas by the sensors 57*a*, 57*b* respectively without interference of the heaters 56*a*, 56*b* from each other.

The plurality of heaters 56*a*, 56*b* of this image forming apparatus are turned on and off as follows. First, a target temperature and a hysteresis temperature are determined for each area to be heated. An OFF temperature is calculated by adding the hysteresis temperature to the target temperature. An ON temperature is calculated by subtracting the hysteresis temperature from the target temperature. Then, when it is determined on the basis of the temperature detected by the temperature sensor 57 that the area to be heated by any one of the heaters 56*a*, 56*b* has cooled to no higher than the ON temperature, the control unit 11 turns on the heater located to heat the area. On the other hand, when it is determined on the basis of the temperature detected by the temperature sensor 57 that the area heated by any one of the heaters 56*a*, 56*b* is heated to no lower than the OFF temperature, the control unit 11 turns off the heater heating the area.

Furthermore, the control unit 11 controls the plurality of heaters 56*a*, 56*b* to prevent two or more heaters from being concurrently on. Namely, while one of the heaters 56*a*, 56*b* is on, the control unit 11 does not turn on any other of the heaters 56*a*, 56*b* even when the area to be heated by this any other heater cools down below the ON temperature. By this configuration, voltage fluctuation is inhibited to prevent flickers. However, flickers cannot sufficiently be inhibited by this control scheme.

Figure 4:
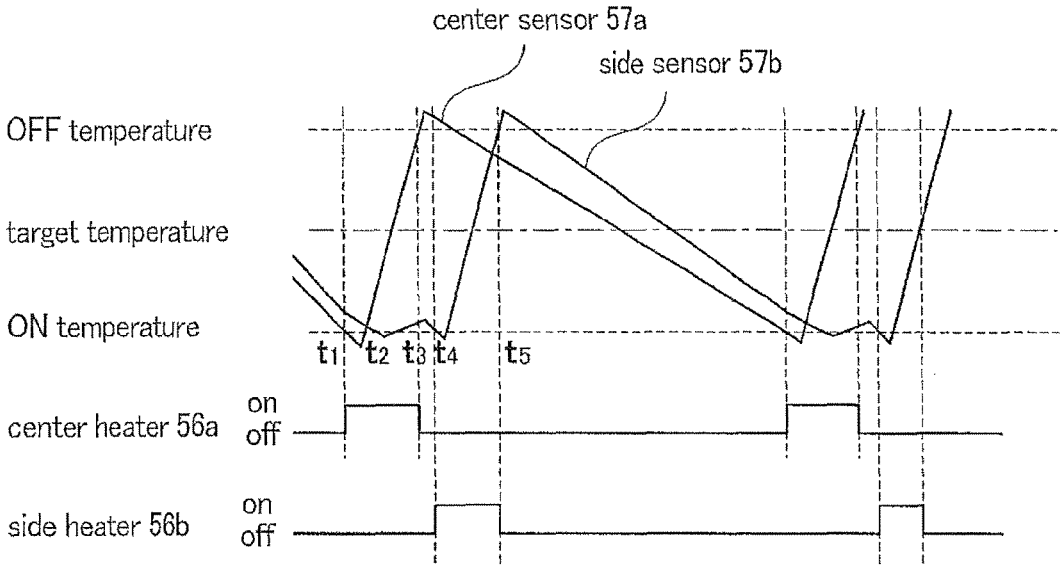
FIG. 4 is a timing chart for showing a comparative example of the method of controlling heaters.

FIG. 4 shows the change in temperatures detected by the center sensor 57*a* and the side sensor 57*b* in a comparative example of the method of controlling heaters. It is assumed that first both the center heater 56*a* and the side heater 56*b* are off. When the area to be heated by the center heater 56*a* cools down to the ON temperature at time t1, the control unit 11 turns on the center heater 56*a*.

Thereafter, the area to be heated by the side heater 56*b* cools down to the ON temperature at time t2. However, since the center heater 56*a* is on at time t2, the control unit 11 does not turn on the side heater 56*b*. Incidentally, the temperature of the area to be heated by the side heater 56*b* is transiently rising after time t2 in FIG. 4 because the center heater 56*a* is somewhat heating also the area to be heated by the side heater 56*b* which remains off.

Next, when the temperature of the area to be heated by the center heater 56*a* rises to the OFF temperature at time t3, the control unit 11 turns off the center heater 56*a*. Thereafter, the area to be heated by the side heater 56*b* cools down again to the ON temperature at time t4. In this case, the control unit 11 turns on the side heater 56*b* because the center heater 56*a* is off. When the area to be heated by the side heater 56*b* is heated to the OFF temperature at time t5, the control unit 11 turns off the side heater 56*b*. The control unit 11 repeats such operations.

As illustrated in FIG. 4, in accordance with this control, voltage fluctuation occurs at time t2, time t3, time t4 and time t5 where flicker may be caused.

On the other hand, the image forming apparatus according to the present embodiment controls the heaters 56*a* and 56*b* as follows. Namely, if one of the heaters 56*a* and 56*b* is on when the area to be heated by the other heater cools down to the ON temperature, the control unit 11 of the present embodiment turns on the other heater with the same timing as the one heater is turned off even if the area to be heated by the one heater is heated again above the ON temperature.

Next, with reference to FIG. 5, a heater control method according to the present embodiment will be explained. It is assumed that both the center heater 56*a* and the side heater 56*b* are off. When the area to be heated by the center heater 56*a* cools down to the ON temperature at time t1, the control unit 11 turns on the center heater 56*a*.

Thereafter, the area to be heated by the side heater 56*b* cools down to the ON temperature at time t2. However, since the center heater 56*a* is on at time t2, the control unit 11 does not turn on the side heater 56*b*. In this case, the control unit 11 determines to turn on the side heater 56*b* at time t2 and waits for the center heater 56*a* to turn off.

Next, when the temperature of the area to be heated by the center heater 56*a* rises to the OFF temperature, the control unit 11 turns off the center heater 56*a*. At this time, according to the present embodiment, the control unit 11 turns on the side heater 56*b* with the same timing as the center heater 56*a* is turned off. When the area to be heated by the side heater 56*b* is heated to the OFF temperature at time t4, the control unit 11 turns off the side heater 56*b*. The control unit 11 repeats such operations.

As has been described above, if one of the heaters 56*a* and 56*b* is on when the area to be heated by the other heater cools down to the ON temperature, the control unit 11 of the present embodiment turns on the other heater with the same timing as the one heater is turned off. This scheme eliminates the period from time t3 to time t4 where both the heaters 56*a* and 56*b* are off. Also, in the case of the present embodiment, voltage fluctuation occurs at time t1, time t3 and time t4, so that the number of times is one time fewer than in the above comparative example resulting in inhibiting occurrence of flickers. Furthermore, the voltage fluctuation at time t3 corresponds only to the differential power consumption between the center heater 56*a* and the side heater 56*b*. The amount of voltage fluctuation at time t3 is smaller, and therefore occurrence of flickers can be further inhibited.

In what follows, the heater control method according to the present embodiment will be explained in detail. The control unit 11 of the present embodiment changes the ON temperature. Namely, when one of the heaters 56*a* and 56*b* is on, the control unit 11 raises the ON temperature of the other heater by a predetermined amount within a temperature range lower than the OFF temperature.

Figure 5:
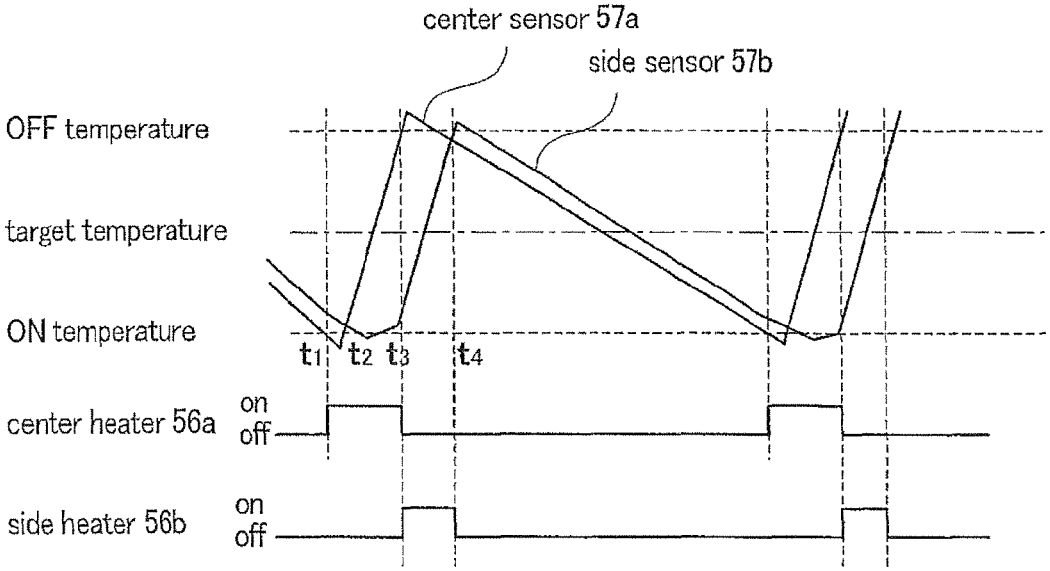
FIG. 5 is a timing chart for showing the method of controlling heaters in accordance with the first embodiment.

Referring to FIG. 5, when the area to be heated by the center heater 56*a* cools down to the ON temperature at time t1, the control unit 11 turns on the center heater 56*a* and raises the ON temperature of the side heater 56*b* by a predetermined amount within a temperature range lower than the OFF temperature. Specifically speaking, in such a case, the control unit 11 according to the present embodiment sets the ON temperature to the OFF temperature. The control unit 11 determines to turn on the side heater 56*b* at time t2 and waits for the center heater 56*a* to turn off.

The above control scheme can thereby be easily implemented. In this case, when heating the center area which is on, the center heater 56*a* heats also the side area to be heated by the side heater 56*b* adjacent to the center heater 56*a*. The area to be heated by the side heater 56*b* may be higher than the ON temperature (the target temperature minus the hysteresis temperature) even when the center heater 56*a* is turned off. However, by raising the ON temperature, the control unit 11 can surely turn on the side heater 56*b* when the center heater 56*a* is turned off.

Meanwhile, it is preferred that the control unit 11 turns off one of the heaters 56*a* and 56*b* and turns on the other heater at the same time in synchronization with the zero crossing point of an AC voltage. This timing makes it possible to inhibit a back electromotive force and a rush current and further inhibit occurrence of flickers.

Figure 6:
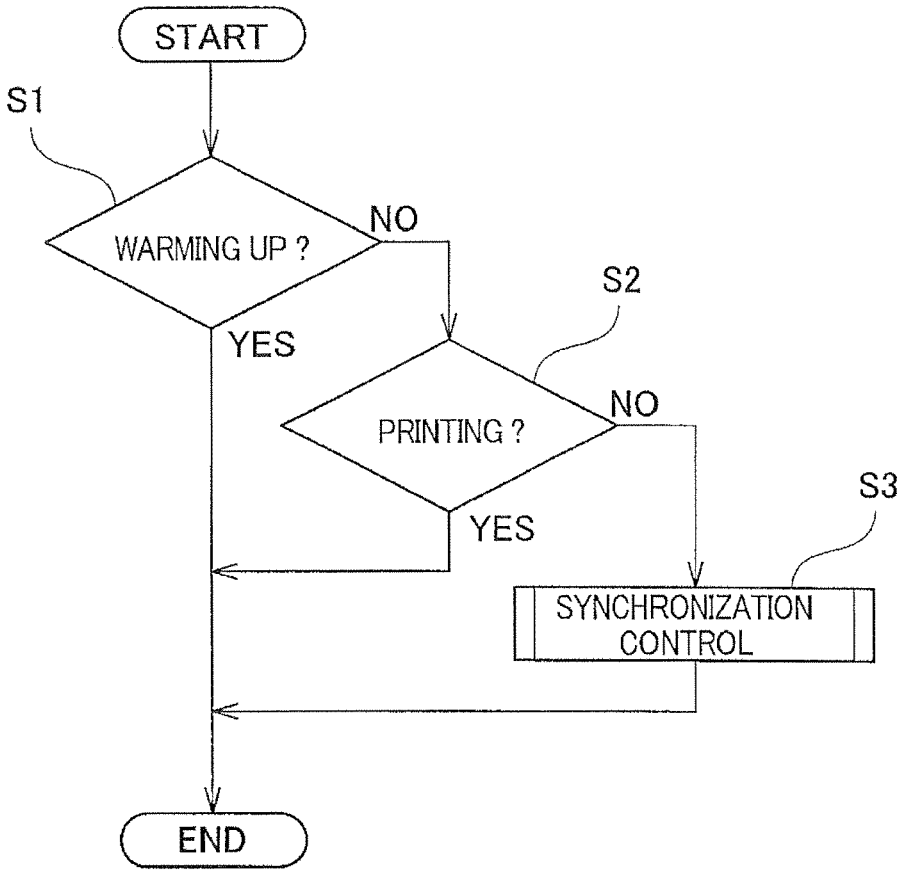
FIG. 6 is a flow chart for showing the basic steps of the heater control method according to the first embodiment.

FIG. 6 is a flow chart for showing the basic steps of the heater control method according to the present embodiment. As shown in FIG. 6, the above synchronization control (S3) is not performed in a warm-up period just after power-up and during image formation for printing. Namely, the synchronization control (S3) is performed only when the image forming apparatus is in a stand-by state.

More specifically explained, the control unit 11 determines whether or not the image forming apparatus is being warmed up (S1). If the control unit 11 determines that the image forming apparatus is being warmed up (S1: YES), the routine shown in FIG. 6 ends. In this case, since the image forming apparatus is being warmed up, the control unit 11 turns on both the heaters 56*a* and 56*b* to quickly warm up the fixing belt 54.

On the other hand, if the control unit 11 determines that the image forming apparatus is not being warmed up (S1: NO), the control unit 11 determines whether or not the image forming apparatus is printing images (S2). If the control unit determines that the image forming apparatus is printing images (S2: YES), the routine shown in FIG. 6 ends. In this case, the control unit 11 controls the heaters 56*a* and 56*b* in an asynchronous fashion so that the heat roller 53 is heated to an appropriate temperature for fixing images.

If the control unit 11 determines that the image forming apparatus is not printing images (S2: NO), the control unit 11 performs the synchronization control (S3). Then, the routine shown in FIG. 6 ends.

Figure 7:
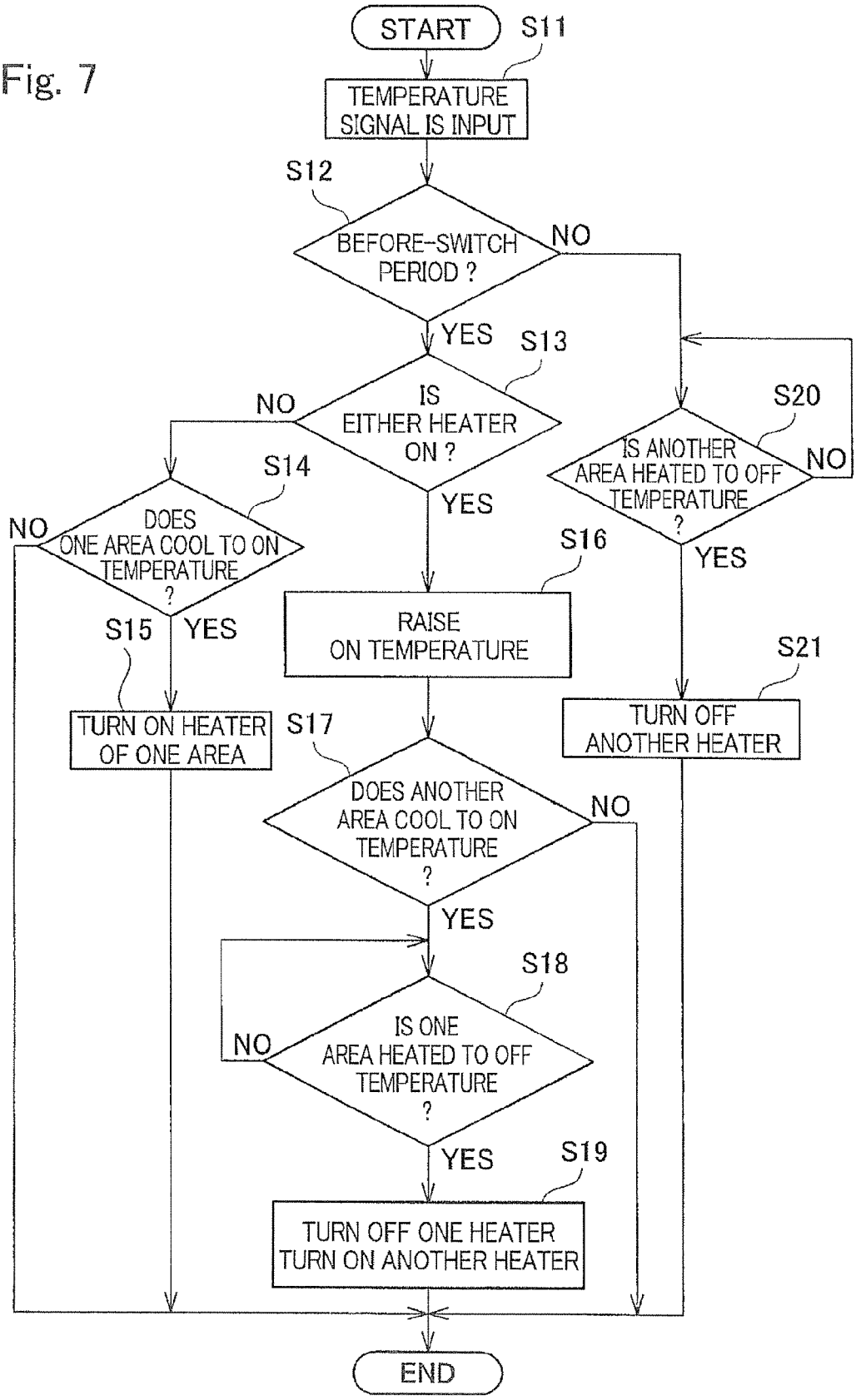
FIG. 7 is a flow chart for showing the details of the synchronization control (S3) shown in FIG. 6.

FIG. 7 is a flow chart for showing the details of the synchronization control (S3) shown in FIG. 6. As shown in FIG. 7, first, a temperature signal is output from the temperature sensor 57 and input to the control unit 11. Next, the control unit 11 determined whether the image forming apparatus is in a before-switch period (S12). The before-switch and after-switch periods are defined here as explained below with reference to FIG. 5.

Namely, the after-switch period is from the time when one of the heaters 56*a* and 56*b* is turned off and at the same time the other heater is turned on, to the time when the other heater is turned off. The before-switch period is all the remaining period. Specifically, in the case shown in FIG. 5, the after-switch period is from time t3 (in which the heaters 56*a* and 56*b* are turned off and on respectively) to time t4 (from which both the heaters 56*a* and 56*b* are in off states). All the remaining period is the before-switch period.

As illustrated in FIG. 7, the image forming apparatus according to the present embodiment performs steps S13 to S19 in the before-switch period, and performs steps S20 and S21 in the after-switch period.

Referring to FIG. 7 again, if it is determined that the image forming apparatus is in the before-switch period (S12: YES), the control unit 11 determines whether or not one of the heaters 56*a* and 56*b* is on (S13). If both the heaters 56*a* and 56*b* are off (S13: NO), the control unit 11 determines whether or not there is an area to be heated which cools down to no higher than the ON temperature (S14).

If it is determined that there is no area to be heated which cools down to no higher than the ON temperature (S14: NO), the routine shown in FIG. 7 ends. Conversely, if it is determined that there is an area to be heated at no higher than the ON temperature (S14: NO), the control unit 11 turns on one of the heaters 56*a* and 56*b* corresponding to this area (S15). Then, the routine shown in FIG. 7 ends.

On the other hand, if it is determined that one of the heaters 56*a* and 56*b* is turned on (S13: YES), the control unit 11 raises the ON temperature of the other heater (S16). In the case of the present embodiment, the control unit 11 sets the ON temperature of the other heater to the OFF temperature. Next, the control unit 11 determines whether or not the area to be heated by the other heater has cooled to no higher than the ON temperature which is raised (S17).

If it is determined that the area to be heated by the other heater has not cooled to the ON temperature (S17: NO), the routine shown in FIG. 7 ends. Conversely, if it is determined that the area to be heated by the other heater has cooled to no higher than the ON temperature (S17: NO), the control unit 11 determines whether or not the area to be heated by the one heater is heated to no lower than the OFF temperature.

If it is determined that the area to be heated by the one heater is not yet heated to the OFF temperature (S18: NO), this step is repeated until this area is determined as being heated to no lower than the OFF temperature (S18: NO). Conversely, if it is determined that the area to be heated by the one heater is heated to no lower than the OFF temperature (S18: YES), the control unit 11 turns off the one heater and turns on the other heater at the same time (S19). Then, the routine shown in FIG. 7 ends. Incidentally, the heaters 56*a* and 56*b* are turned off and on respectively in synchronization with the zero crossing point of an AC voltage. Also, after step S19, this process enters the after-switch period.

On the other hand, if it is determined that the image forming apparatus is not in the before-switch period (S12: NO), the control unit 11 determines whether or not the area to be heated by the other heater is heated to no lower than the OFF temperature (S20). If it is determined that the area to be heated by the other heater is not yet heated to the OFF temperature (S20: NO), this step is repeated until this area is determined as being heated to no lower than the OFF temperature (S20: NO).

If it is determined that the area to be heated by the other heater is heated to no lower than the OFF temperature (S20: YES), the control unit 11 turns off the other heater. Then, the routine shown in FIG. 7 ends.

Next, the heater control temperature according to the present embodiment, i.e., the ON temperature will be explained by comparing FIG. 8 with FIG. 5. First, both the heaters 56*a* and 56*b* are off before time t1 as shown in FIG. 5, i.e., in the before-switch period. The requirement for the center heater 56*a* in the before-switch period shown in FIG. 8, i.e., "center or side heater is on", is not satisfied. Because of this, the ON temperature of the center heater 56*a* is the target temperature minus the hysteresis temperature. Likewise, the requirement for the side heater 56*b* in the before-switch period shown in FIG. 8, i.e., "center or side heater is on", is not satisfied. Because of this, the ON temperature of the side heater 56*b* is the target temperature minus the hysteresis temperature.

Next, when the center heater 56*a* is turned on at time t1 as shown in FIG. 5, the requirement for the center heater 56*a* in the before-switch period, i.e., "center or side heater is on", is satisfied. The ON temperature of the center heater 56*a* is thereby raised to the target temperature plus the hysteresis temperature. Because of this, when the determination in step S13 of FIG. 7 is affirmative (YES), the ON temperature is raised in step S16 not only for the other heater but also for the one heater.

Furthermore, when the center heater 56*a* is turned on at time t1 as shown in FIG. 5, the requirement for the side heater 56*b* in the before-switch period, i.e., "center or side heater is on", is satisfied in the same manner. The ON temperature of the side heater 56*b* is thereby raised to the target temperature plus the hysteresis temperature. This is performed in step S16. Meanwhile, since the center heater 56*a* remains on at this time, the side heater 56*b* is not turned on.

Next, when the temperature of the area to be heated by the center heater 56*a* rises to the OFF temperature at time t3, the control unit 11 turns off the center heater 56*a*. On the other hand, since the temperature of the area to be heated by the side heater 56*b* is lower than the ON temperature (the target temperature+the hysteresis temperature) while the control unit 11 determines to turn on the side heater 56*b*, the control unit 11 turns on the side heater 56*b* with the same timing as the other heater is turned off. Then, the before-switch period is switched to the after-switch period.

The center heater 56*a* and the side heater 56*b* are off and on respectively after time t3. In this case, the requirement for the center heater 56*a* in the after-switch period shown in FIG. 8, i.e., "center heater is on", is not satisfied. Because of this, the ON temperature of the center heater 56*a* is the target temperature minus the hysteresis temperature. On the other hand, the requirement for the side heater 56*b* in the after-switch period, i.e., "side heater is on", is satisfied. The ON temperature of the side heater 56*b* is thereby raised to the target temperature plus the hysteresis temperature. Although omitted from the flow chart shown in FIG. 7, when the determination in step S12 is negative (NO), the ON temperature of the other heater is raised in advance of performing step S20.

Next, when the area to be heated by the side heater 56*b* is heated to the OFF temperature at time t4, the control unit 11 turns off the side heater 56*b* followed by switching to the before-switch period. In this case, the requirement for the center heater 56*a* in the before-switch period, i.e., "center or side heater is on", is not satisfied. Because of this, the ON temperature of the center heater 56*a* is the target temperature minus the hysteresis temperature. Likewise, the requirement for the side heater 56*b* in the before-switch period, i.e., "center or side heater is on", is not satisfied. Because of this, the ON temperature of the side heater 56*b* is the target temperature minus the hysteresis temperature. The control unit 11 repeats such operations.

Incidentally, the requirement that "center or side heater is on" in the before-switch period shown in FIG. 8 is provided because the center heater 56*a* is not necessarily turned on first, but the side heater 56*b* may be turned in advance of the center heater 56*a*.

In accordance with the structure as described above, if one of the heaters 56*a* and 56*b* is on when the area to be heated by the other heater cools down to the ON temperature, the other heater is turned on with the same timing as the one heater is turned off so that the heaters 56*a* and 56*b* are turned on and off respectively at the same time to decrease the amount of voltage fluctuation and inhibit occurrence of flickers.

When the one heater is on, the ON temperature of the other heater is raised by a predetermined amount within a temperature range lower than the OFF temperature. Because of this, the above control scheme can thereby be easily implemented. This can reduce the possibility that the heaters 56*a* and 56*b* are asynchronously turned on and off.

Furthermore, since the heaters 56*a* and 56*b* are turned on and off at the same time in synchronization with the zero crossing point of an AC voltage, it is possible to inhibit a back electromotive force and a rush current and further inhibit occurrence of flickers.

Each of the temperature sensors 57 is located closer to the area to be detected by this each temperature sensor than the other temperature sensors 57, and therefore it is possible to accurately measure the temperature of this area without interference of the other areas.

The synchronization control of turning on and off the heaters 56*a* and 56*b* respectively at the same time is not performed in a warm-up period just after power-up and during image formation for printing, but performed only when the image forming apparatus is waiting for the command to form an image in a stand-by state after warming up. Namely, when the heating operation has a priority, the synchronization control is not performed to avoid degradation in fixing performance. On the other hand, in a stand-by state, occurrence of flickers can be inhibited.

Figure 9:
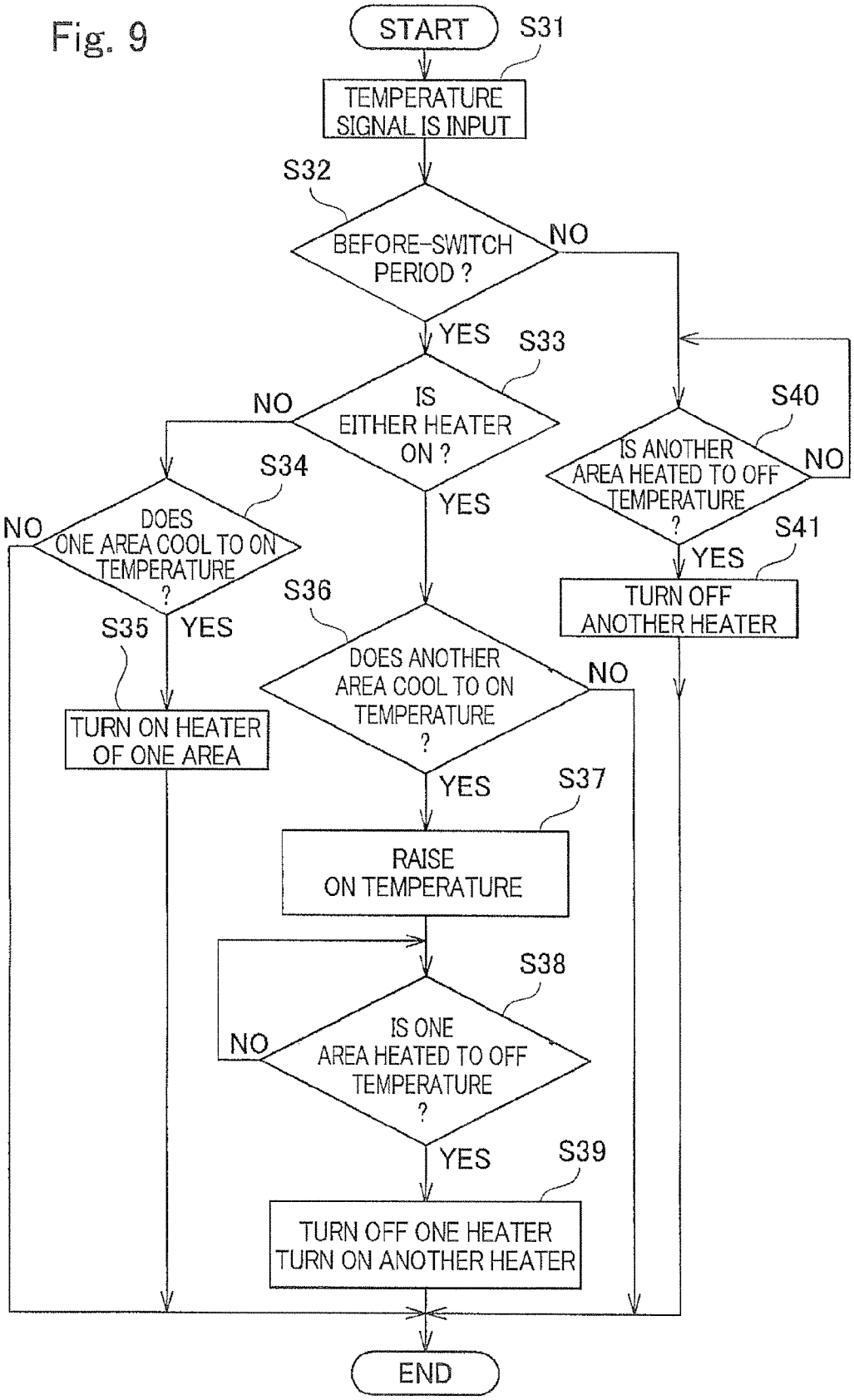
FIG. 9 is a flow chart for showing the details of the synchronization control (S3) shown in FIG. 6 in accordance with a second embodiment.

FIG. 9 is a flow chart for showing the details of the synchronization control (S3) in accordance with a second embodiment. Incidentally, steps S31 to S35, S40 and S41 shown in FIG. 9 are performed in the same manner as steps S11 to S15, S20 and S21 inside of FIG. 7, and therefore no redundant description is repeated.

In FIG. 9, when it is determined that one of the heaters 56*a* and 56*b* is on (S33: YES), the control unit 11 determines whether or not the area to be heated by the other heater has cooled to no higher than the ON temperature (S36). If it is determined that the area to be heated by the other heater has not cooled to the ON temperature (S36: NO), the routine shown in FIG. 9 ends. Referring to FIG. 5, the area to be heated by the side heater 56*b* (the other heater) has not cooled to the ON temperature in the period between time t1 and time t2, the determination in step S36 is negative (NO).

Referring to FIG. 9, if it is determined that the area to be heated by the other heater has cooled to the ON temperature (S36: YES), the control unit 11 raises the ON temperature of the other heater (S37). This step S37 is performed at time t2 in the case of FIG. 5.

As described above, the image forming apparatus according to the second embodiment differs from the image forming apparatus according to the first embodiment in that the ON temperature is raised after determining that the area to be heated by the other heater has cooled to the ON temperature.

Thereafter, steps S38 and S39 are performed in the same manner as steps S18 and S19 of FIG. 7, and then the routine shown in FIG. 9 ends.

In accordance with the structure as described above, it is possible to decrease the amount of voltage fluctuation and inhibit occurrence of flickers in the same manner as the first embodiment. Also, it is possible to inhibit a back electromotive force and a rush current and further inhibit occurrence of flickers.

Furthermore, it is possible to accurately measure the temperature of each area to be heated without interference of the other areas, and inhibit occurrence of flickers while avoiding degradation in fixing performance.

Furthermore, in accordance with the second embodiment, if one of the heaters 56*a* and 56*b* is on when the area to be heated by the other heater cools down to the ON temperature, the ON temperature of the other heater is raised by a predetermined amount within a temperature range lower than the OFF temperature. Because of this, even if the area to be heated by the other heater is heated by the one heater after this area cools down to the ON temperature, the temperature of this area hardly rises beyond the ON temperature. This can reduce the possibility that, when the one heater is turned off, the area to be heated by the other heater rises beyond the ON temperature so that the other heater is not turned on to disturb the synchronous operation of turning on and off the heaters 56*a* and 56*b*.

The image forming apparatus and heater control method have been explained on the basis of the embodiments in accordance with the present invention. However, it is not intended to limit the present invention to the precise form described, and obviously many modifications and variations are possible without departing from the scope of the invention as well as any combination of these embodiments.

For example, while there are only the center and side heaters in the above embodiments, any other heaters such as front, bottom or the like heaters may be provided so that there are three or more heaters which are independently controlled. In such a case, when one heater is turned on in the before-switch period, one of the other heaters corresponding to the coolest area is determined as "the other heater" which is described in the above embodiments, followed by performing the above control until the other heater is turned off without considering the remaining heaters. Furthermore, the plurality of heaters 56 are located to heat the fixing roller 52 in the above embodiments. However, heaters may be located to heat the pressure roller 51 instead or located to heat both the fixing roller 52 and the pressure roller 51.

Furthermore, the fixing roller 52 is provided with the fixing belt 54. However, this fixing belt 54 can be dispensed with. In this case, the plurality of heaters 56 may be located in the fixing roller 52 in place of the heat roller 53.

Also, any appropriate roller may be provided in addition to the rollers 51, 52 and 55, and the plurality of heater 56 may be provided in this roller. Furthermore, the plurality of heater 56 may be provided outside of a roller.

What is claimed is:

1. An image forming apparatus provided with a fixing unit which fixes an image formed on a paper sheet by passing the paper sheet between a pair of rotatable members, comprising:

a plurality of heaters configured to heat at least one of the rotatable members;

a plurality of temperature detection units configured to detect the temperatures of areas to be heated by said plurality of heaters respectively; and a control unit configured to turn off each of the plurality of heaters when the temperature detected by one of the temperature detection units corresponding to the each heater rises to an OFF temperature, and turn on each of the plurality of heaters when the temperature detected by one of the temperature detection units corresponding to the each heater falls to an ON temperature, wherein if a first heater of said plurality of heaters is on when a second heater of said plurality of heaters cools down to the ON temperature, the control unit turns off the first heater and turns on the second heater at the same time when the area to be heated by the first heater is heated to the OFF temperature, wherein the control unit does not perform the operation of turning off the first heater and turning on the second heater at the same time in a warm-up period just after power-up and during image formation for printing, but does perform this operation when the image forming apparatus is waiting for a command to form an image in a stand-by state after warming up, wherein when the first heater is on, the control unit raises the ON temperature of the second heater by a predetermined amount within a temperature range lower than or equal to the OFF temperature.

2. The image forming apparatus of claim 1, wherein when the area to be heated by the second heater cools down to the ON temperature while the first heater is on, the control unit raises the ON temperature of the second heater by a predetermined amount within a temperature range lower than or equal to the OFF temperature.

3. The image forming apparatus of claim 1, wherein the control unit turns off the first heater and turns on the second heater at the same time in synchronization with the zero crossing point of an AC voltage.

4. The image forming apparatus or claim 1, wherein the plurality of temperature detection units are a plurality of temperature sensors, each temperature sensor is located closer to an area to be detected by this temperature sensor than the other temperature sensors.

5. A heater control method for an image forming apparatus provided with a fixing unit which fixes an image formed on a paper sheet by passing the paper sheet between a pair of rotatable members, comprising:

a heating step of heating at least one of the rotatable members with a plurality of heaters;

a temperature detecting step of detecting the temperatures of areas to be heated by said plurality of heaters respectively; and a control step of turning off each of the plurality of heaters when the temperature detected by one of the temperature detecting units corresponding to the each heater rises to an OFF temperature, and turning on each of the plurality of heaters when the temperature detected by one of the temperature detection units corresponding to the each heater falls to an ON temperature, wherein if a first heater of said plurality of heaters is on when a second heater of said plurality of heaters cools down to the ON temperature, in the control step, performing an operation in which the first heater is turned off and the second heater is turned on at the same time when the area to be heated by the first heater is heated to the OFF temperature, wherein the operation of turning off the first heater and turning on the second heater at the same time is not performed in a warm-up period just after power-up and during image formation for printing, but the operation is performed when the image forming apparatus is waiting for a command to form an image in a stand-by state after warming up, wherein when the first heater is on, in the control step, raising the ON temperature of the second heater by a predetermined amount within a temperature range lower than or equal to the OFF temperature.

* * * * *